US007353973B2

(12) United States Patent
Rohr

(10) Patent No.: US 7,353,973 B2
(45) Date of Patent: Apr. 8, 2008

(54) SEAL RETAINER FOR USE IN LIQUID-STORAGE CONTAINERS

(75) Inventor: Robert D. Rohr, LaOtto, IN (US)

(73) Assignee: Rieke Corporation, Auburn, IN (US)

( * ) Notice: Subject to any disclaimer, the term of this patent is extended or adjusted under 35 U.S.C. 154(b) by 270 days.

(21) Appl. No.: 11/080,269

(22) Filed: Mar. 15, 2005

(65) Prior Publication Data

US 2006/0102662 A1 May 18, 2006

Related U.S. Application Data

(60) Provisional application No. 60/628,046, filed on Nov. 15, 2004.

(51) Int. Cl.
*B65D 5/72* (2006.01)
*B65D 25/00* (2006.01)

(52) U.S. Cl. ..... 222/570; 222/109; 220/700; 220/702

(58) Field of Classification Search ..... 222/566–571, 222/109, 108, 111, 542; 220/773, 770, 806, 220/356, 354, 495.02, 700, 702; 206/509, 206/508

See application file for complete search history.

(56) References Cited

U.S. PATENT DOCUMENTS 3,366,272 A * 1/1968 Ballmann ..... 220/698
4,893,723 A * 1/1990 Seabolt ..... 220/570
4,917,270 A * 4/1990 Simon ..... 222/111
5,101,993 A 4/1992 Nairn et al.
5,251,788 A * 10/1993 Moore ..... 222/111
5,641,089 A * 6/1997 Palank ..... 220/733
7,040,509 B2 * 5/2006 McLelland et al. ..... 222/109
2004/0011812 A1 1/2004 Kasting et al.
2004/0011813 A1 1/2004 Kasting et al.

FOREIGN PATENT DOCUMENTS

GB 2206567 A1 1/1989
WO WO03/088791 A1 10/2003

OTHER PUBLICATIONS

European Search Report from counterpart European Application No. 05 25 5161, Search Completion Date Feb. 28, 2006.

* cited by examiner

*Primary Examiner*—Kevin Shaver
*Assistant Examiner*—Stephanie E. Tyler
(74) *Attorney, Agent, or Firm*—Woodard, Emhardt, Moriarty, McNett & Henry LLP

(57) ABSTRACT

A sealing mechanism for a container for sealing an interface between two or more of the structural members includes a container body and a pouring spout. The pouring spout includes a ridge for securing the spout to the container body and a retention ridge that is positioned near the rim of the container body, once assembled. An angled retention surface on the spout is used to properly position a seal between the pouring spout and the container.

17 Claims, 5 Drawing Sheets

SEAL RETAINER FOR USE IN LIQUID-STORAGE CONTAINERS

REFERENCE TO RELATED APPLICATIONS

The present application claims the benefit of U.S. Provisional Patent Application No. 60/628,046, filed Nov. 15, 2004, which is hereby incorporated by reference in its entirety.

BACKGROUND

The present invention relates in general to the sealing of an interface between two or more members, such as between a container body and a container spout. More specifically, but not exclusively, the present invention concerns sealing mechanisms, structures, and techniques to be used in combination with liquid-storage containers which may be used to store (and dispense) various liquid substances such as paint, household cleaners, laundry products, and beverages, to name a few.

Liquid storage containers have been used to store and dispense a wide variety of liquids. While the use of a pouring spout as part of a liquid-storage container is now commonly used for liquid laundry detergents and fabric softeners, only recently have these types of containers been adapted to other liquid-product containers, in particular paint containers. Typical metal paint cans include a generally cylindrical can body with a circular upper opening surrounded by a generally U-shaped peripheral channel which captures the outer peripheral lip or protrusion of a circular lid. A wire-like metal handle is provided and hinged at opposite ends to the paint can body. Anyone who has done any painting using such a paint can is no doubt familiar with the many problems in the sense of wasted and splattered paint. The awkwardness of pouring paint from the can into a tray for a roller is also seen as a drawback with this particular design. Dipping a paintbrush into the can and then using the can edge as a wiping edge also creates a mess and causes paint to be deposited in the annular U-shaped channel. As paint collects in this peripheral channel, resealing the lid becomes particularly messy as the captured paint is pushed out and may either splatter or run down the side of the paint can. Aside from the mess, the current metal paint can design results in wasted paint, not only from what drips, splatters, or runs down the side of the can, but also from not being able to tightly reseal the lid onto the can body. If the lid is not tightly resealed on the can body, the paint can dry out or skim over, causing obvious problems of continued use and often resulting in the leftover portion of paint being discarded.

By designing a paint container with a screw-on lid and a pouring spout with an excess paint drain-back feature, a number of the disadvantages with metal paint cans and the use of such cans can be eliminated. While plastic containers with spouts are now in use for laundry products, there are a number of reasons why such containers are not suitable for paint and why significant design changes must be invented to be able to create a suitable paint container with these structural features. For example, the size of the opening in the container body needs to be expanded for a paint container as compared to a liquid laundry detergent and, as such, the spout design must change. As this occurs, the sealing mechanisms or structures have to be considered. There is a desire to have a wiping edge for the paintbrush as part of a suitable paint container, a factor which is not a consideration with a liquid laundry detergent. The attempt to incorporate this type of wiping edge as part of the pouring spout presents additional design challenges. The drain-back feature is also an important part of any new and improved paint container. Any paint which is wiped off the brush or drips from the brush and any paint which might run down the lip of the pouring spout needs to have a path to reenter the body of the paint container.

A further consideration for a suitable paint container is the overall shape and balance, not only for handling and transporting convenience, including the possibility of stacking, but also for the practical consideration of being able to tint to a particular color by adding pigment to a base color, such as white. This tinting requires access to the interior of the paint container body and also requires some type of vibratory shaking of the paint container. This in turn focuses some attention on the design in terms of the size and shape of the container as well as the design of the sealing mechanisms which are employed as part of the paint container at those interfaces where leakage could conceivably occur.

In developing such containers, the costs and difficulties associated with manufacturing the containers is always a concern. One manufacturing issue relates to the ability to maintain the position of the seal between the container and the spout during assembly. As mentioned before, the seal between the pouring spout and the container must survive a number of drastic conditions, including vibratory shaking. In one type of design, an o-ring seal or gasket is used to seal between the spout and the container. During assembly, the seal is rolled up around a frustum-shaped sidewall of the spout that extends within the container so that the seal is positioned at the lip of the container. As the seal rolls up the frustum-shaped wall, the seal stretches and twists, which in turn pre-loads the seal. As a result, the seal is biased to roll back down towards the narrower part of the wall, away from the lip of the container. With the seal out of position, leakage between the spout and the container can occur, which can be extremely undesirable with liquids like paint.

Thus, there is a need for improvement in this field.

SUMMARY

One aspect of the present invention concerns a spout for a container that includes a retention ridge and an angled retention surface that biases a seal to the proper position for forming a seal between the spout and the container. Another aspect concerns a container that includes means for biasing a seal to the proper position between the spout and the container. Still yet another aspect concerns a technique for assembling a container in which the retention surface is used to position the seal into the proper position.

Related objects and advantages of the present invention will be apparent from the following description.

DESCRIPTION OF SELECTED EMBODIMENTS

Figure 1:
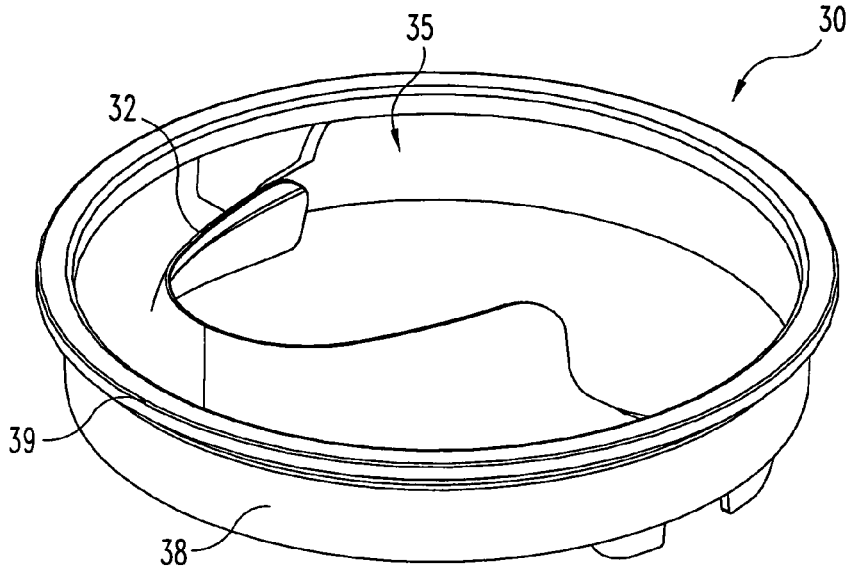
FIG. 1 is a perspective view of a spout with a seal retainer according to one embodiment of the present invention.

For the purpose of promoting an understanding of the principles of the invention, reference will now be made to the embodiments illustrated in the drawings and specific language will be used to describe the same. It is understood that the specific language and figures are not intended to limit the scope of the invention only to the illustrated embodiment. It is also understood that alterations or modifications to the invention or further application of the principles of the invention are contemplated as would occur to persons of ordinary skill in the art to which the invention relates. One embodiment of the invention is shown in great detail, although it will be apparent to those skilled in the relevant art that some features that are not relevant to the present invention may not be shown for the sake of clarity as well as brevity.

One or more embodiments of the present invention will be described below with reference to molded plastic paint containers with a pouring spout, but it should be recognized that features of this invention can be adapted for use with other types of containers and/or liquids. For some background information about the container systems in which the systems and techniques described below can be used, please refer to U.S. patent application Ser. No. 10/924,419, which was filed Aug. 24, 2004; U.S. Application Publication No. 2004/0011813 A1 (application Ser. No. 10/365,910, filed Feb. 13, 2003); and U.S. Application Publication No. 2004/0011812 A1 (application Ser. No. 10/199,618, filed Ser. No. 10/199,618), which are hereby incorporated by reference in their entirety.

Figure 2:
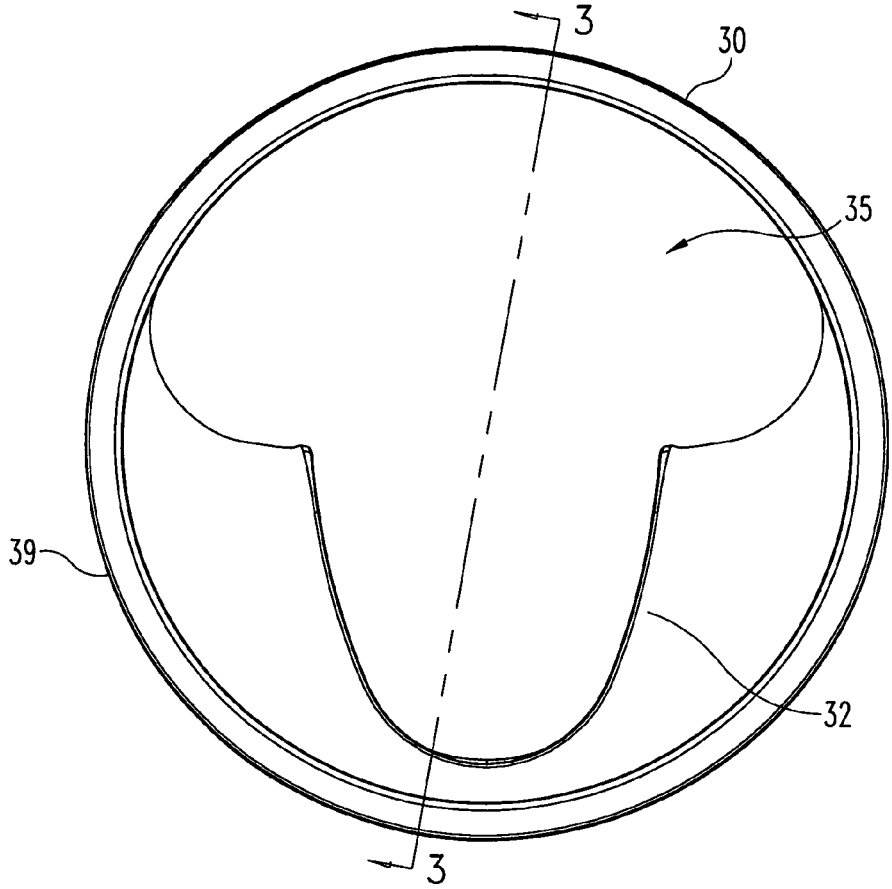
FIG. 2 is a top plan view of the FIG. 1 spout.
Figure 3:
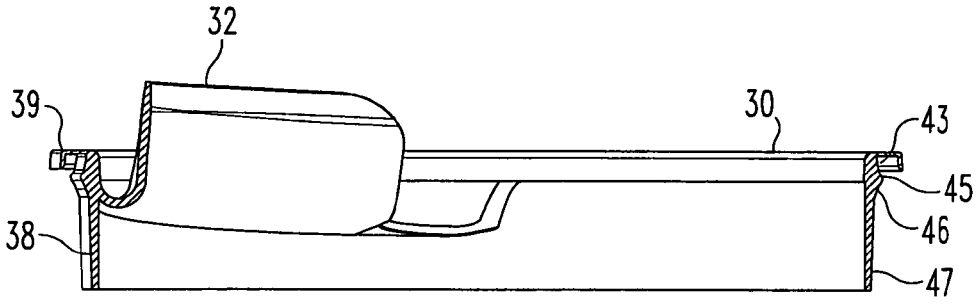
FIG. 3 is a cross-sectional of the FIG. 1 spout as viewed along line 3-3 of FIG. 2.

A spout 30 according to one embodiment, among others, of the present invention is illustrated in FIGS. 1, 2 and 3. As shown, the spout 30 has a pouring lip 32 with a spout opening 35 from where liquid is poured. Around the spout opening 35, the spout 30 has a sidewall 38 and a retention flange 39 that extends radially outwards from the sidewall 38. In the illustrated embodiment, the spout 30 is made of plastic, but it should be appreciated that the spout 30 can be made of other types of materials. As can be seen, the spout 30 has an overall annular shape. However, it is contemplated that the spout 30 in other embodiments can have a different overall shape.

Figure 4:
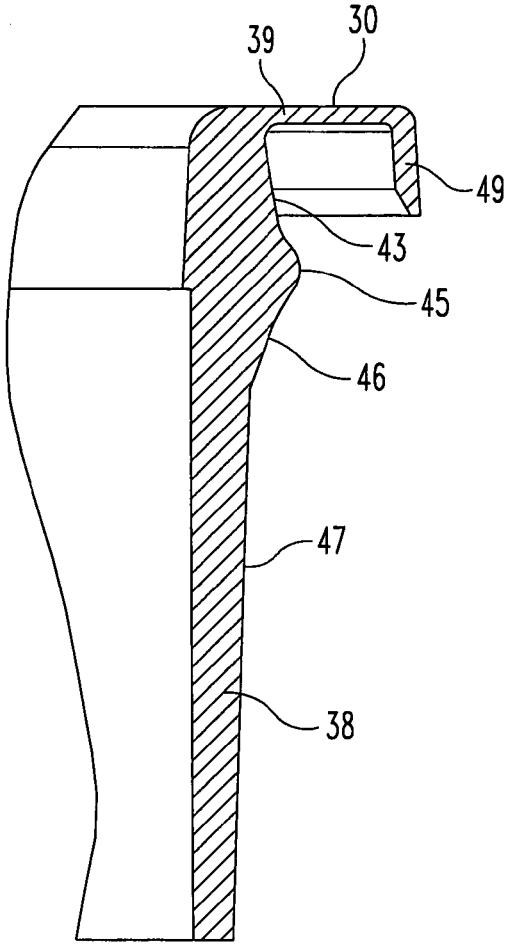
FIG. 4 is an enlarged cross-sectional view of the FIG. 1 spout.

Referring now to FIG. 4, the sidewall 38 of the spout 30 has a frustoconical shape. That is, the sidewall 38 generally tapers away from the retention flange 39 such that the outer diameter of the sidewall 38 generally becomes smaller as it extends farther away from the retention flange 39. The sidewall 38 includes a retention surface 43 that tapers from a raised rib 45 towards the retention flange 39. In the illustrated embodiment, the retention surface 43 angles directly from the raised rib 45 to the retention flange 39 so as to bias a seal against the retention flange 45. As depicted, the rib 45 is rounded and continuous in nature. It nevertheless should be appreciated that the rib 45 can be shaped differently in other embodiments. For example, the rib 45 in another embodiment can be discontinuous or segmented. Opposite the retention surface 43, the sidewall 38 has an angled ramp surface 46, which tapers away from the rib 45. From the ramp surface 46, the sidewall 38 has a distal surface 47 that is angled to a lesser extent than the ramp surface 46, and yet still, slightly tapers away from the retention flange 39. In FIG. 4, a lip member 49 extends from the retention flange 39 at a location radially outwards from the sidewall 38.

Figure 5:
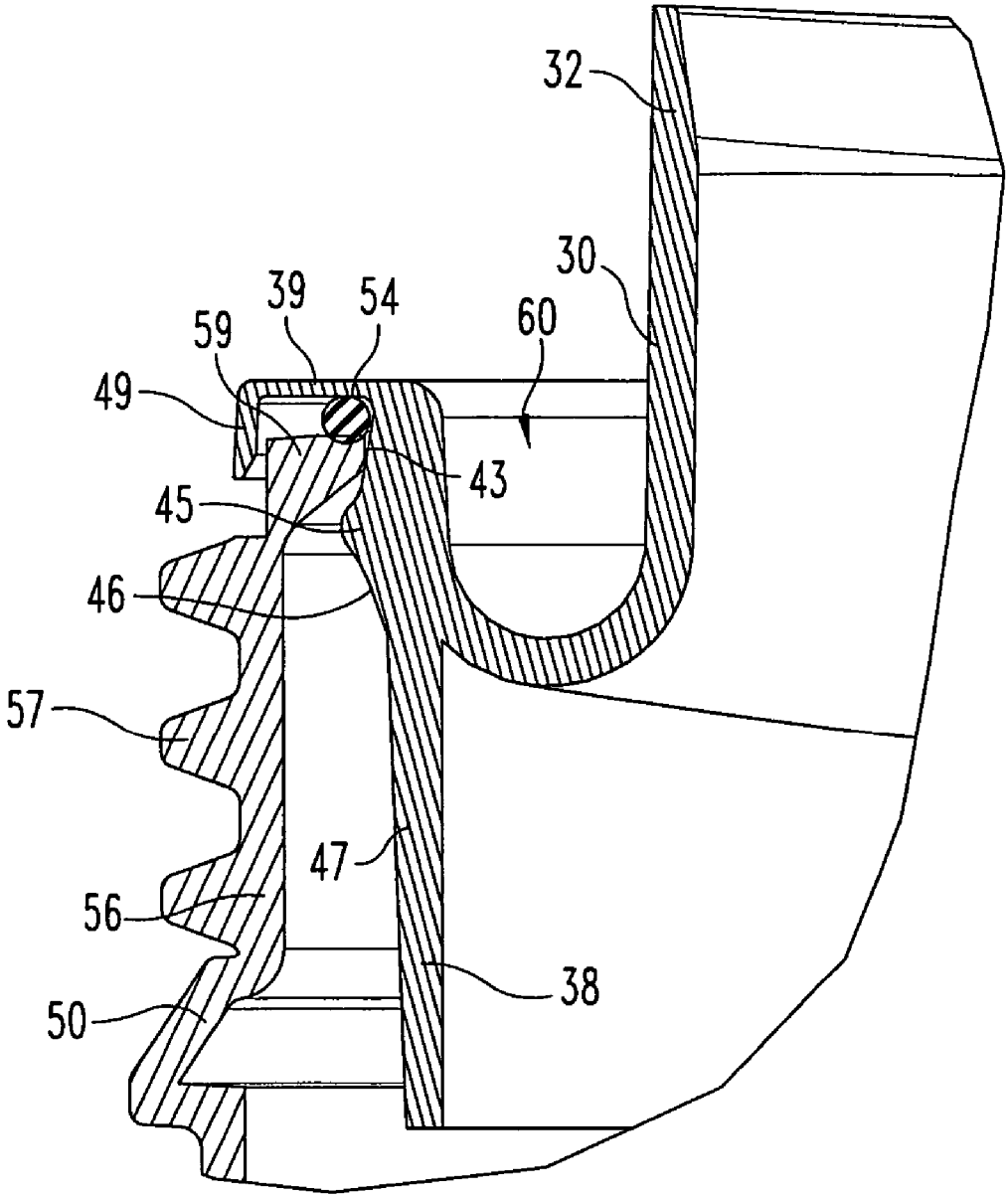
FIG. 5 is a cross-sectional view of the sealing interface between the FIG. 1 spout and a container.

FIG. 5 illustrates the interface between the spout 30, a container 50, and a spout seal 54 that seals between the container 50 and the spout 30. During transit and pouring of fluid from the container 50, maintaining a seal between the spout 30 and container 50 is critical to prevent leakage. By having the seal 54 as a separate component, the seal 54 can compensate for most tolerance differences between the spout 30 and the container 50. The spout seal 54 in the illustrated embodiment is an o-ring seal, but the spout seal 54 can be shaped differently in other embodiments. For instance, the spout seal 54 can include a gasket with a rectangular cross-sectional shape or other shapes. In the embodiment shown, the container 50 has a neck 56 with external threading 57 for securing a cap to the container 50. As should be realized, the cap can be secured to the container 50 in other manners.

During assembly, the spout seal 54 is rolled, or moved in some other manner, up along the sidewall 38 and over the rib 45, which in turn stretches the seal 54 and builds up potential energy. Due to the overall frustum shaped of the sidewall 38, the spout seal 54 would tend to roll out of position were it not for the retention surface 43 and the rib 45. The retention surface 43 and the rib 45 on the spout 30 form an undercut portion of the sidewall 38 that is used to secure the spout 30 to the container 50 as well as ensure that the spout seal 54 remains in the proper location for sealing between the container 50 and the spout 30. The retention surface 43 is angled or tapers to the retention flange in order to encourage the spout seal 54 to bias against the retention flange 39. In the illustrated embodiment, the neck 56 of the container 50 has an angled rim member 59 that extends radially inwards, around opening 60 the container 50. After the seal 54 is installed, the sidewall 38 of the spout 30 is inserted into the opening 60 of the container 50, and the rim member 59 of the container 50 snaps over the rib 46 on the spout 30, thereby locking the spout 30 to the container 50. The interference fit between the spout 30 and the container 50 along with the angled retention surface 43 presses the spout seal 54 into the proper sealing position between the spout 30 and the container 50. In the FIG. 5 embodiment, the proper sealing position for the seal 54 is between the rim member 59 of the container 50 and the retention flange 39 of the spout 30. It, however, should be recognized that the spout 30 and/or the container 50 can be shaped differently in other embodiments to bias the seal 54 so as to form seal at a different location between the container 50 and the spout 30. For instance, in some further embodiments, it is contemplated that the structure for biasing the seal 54 can be formed on the container 50, on the container 50 in conjunction with the spout 30, on the seal 54, on one or more separate components, or some combination thereof.

Sometimes it is necessary that the spout 30 be removed from the container 50 after the container 50 has been filled. For example, in order to tint or mix paint in the container 50, the spout 30 is removed in order to provide unrestricted access to the container 50. With the retention surface 43 and the retention flange 45, the seal 54 remains secured to the spout 30 upon the removal of the spout 30 from the container 50. This reduces the chances that the seal 54 becomes misplaced or even lost. Further, the risk of the seal 54 being damaged by falling on the floor or into paint is reduced. Once the spout 42 is reinstalled on the container 50, the seal 54 is again position in the proper location between the container 50 and the spout 30.

Figure 6:
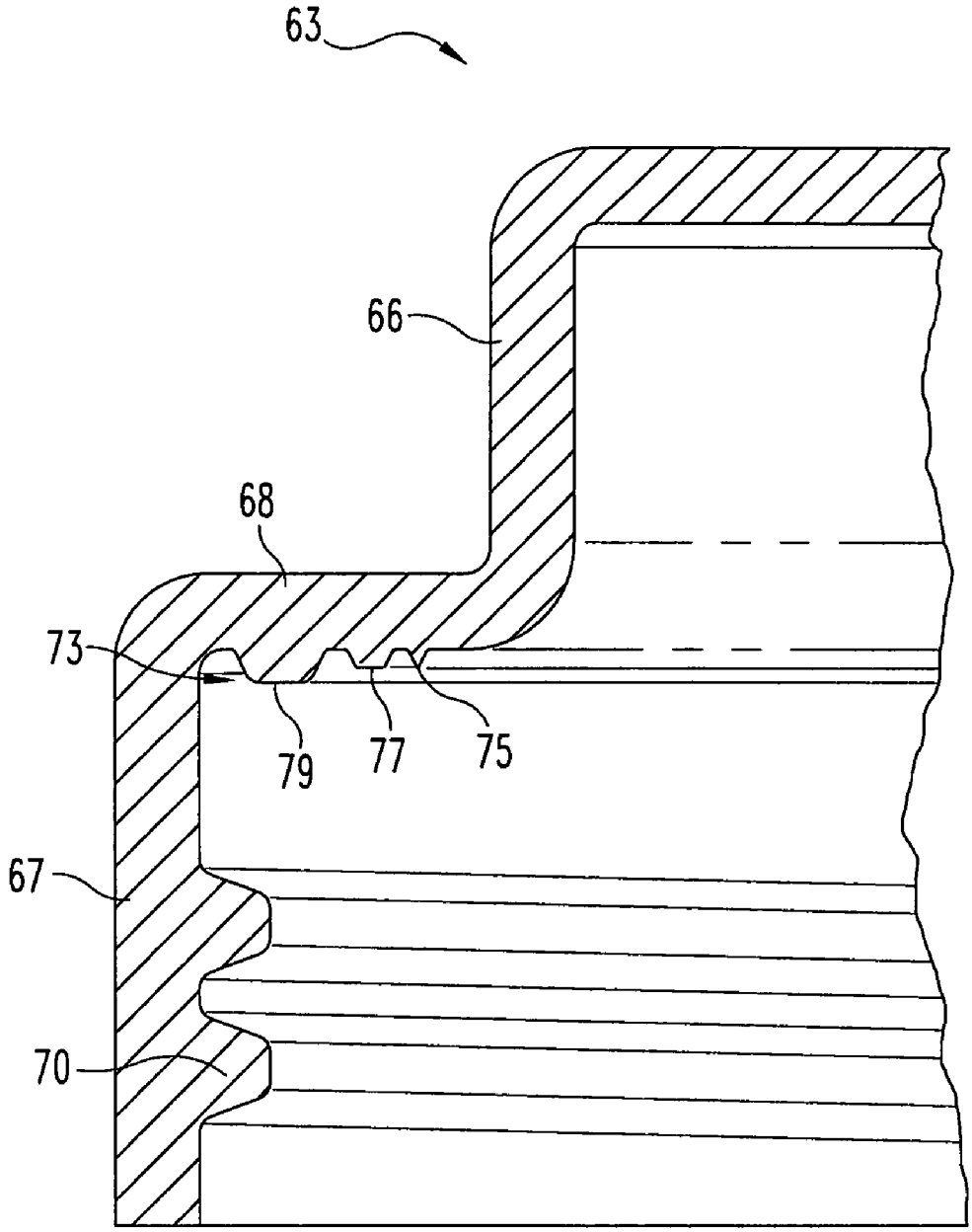
FIG. 6 is a partial cross-sectional view of a cap that encloses the FIG. 1 spout and the container.

During shipping or storage, the container 50 can be sometimes jarred such that the spout 30 separates from the container 50, thereby creating a potential leakage source. A cap 63 for enclosing the container 50, which is illustrated and FIG. 6, is configured to reduce this type of leakage source. In the illustrated embodiment, the cap 63 is generally cylindrical in shape, but it should be recognized that the cap 63 can be shaped differently in other embodiments. As shown, the cap 63 includes an upper cover portion 66, a outer collar 67 that is configured to secure to the neck 56 of the container 50, and a seal land portion 68 that extends between the cover portion 66 and the collar 67. The collar 57 has internal threading 70 that engages the threading 57 on the neck 56 of the container 50, as is depicted in FIG. 7.

Looking at FIG. 6, the seal land 68 has a series of internal seal structures 73 that are rib-shaped for sealing the container 50. The seal structures 73 in the illustrated embodiment includes a seal rib or protrusion 75 that is deformable to seal against the retention flange 39 of the spout 30. By sealing against the retention flange 39, the seal rib 75 minimizes leakage between the cap 63 and the spout 30. The seal rib 75 in the embodiment shown has a triangular cross-sectional shape such that the seal rib 75 is able to deform, but in other embodiments, the seal rib 75 can be shaped differently. Located radially outward from the seal rib 75, the seal land 68 has a support rib 77 that is configured engage the retention flange 39 near the seal 54 such that the seal 54 is compressed between the spout 30 and the container 50. In the FIG. 6 embodiment, the support rib 77 has a trapezoidal shape with a flat surface to firmly press against the retention flange 39. The support rib 77 is slightly shorter than the seal rib 75 so that the seal rib 75 is able to seal against the retention flange 39. As should be appreciated, the support rib 77 can have a different shape in other embodiments. Near the lip 49 of the spout 30, a biasing member or rib 79 is positioned radially outwards from both the seal rib 75 and the support rib 77. In the illustrated embodiment, the biasing rib 79 has a trapezoidal cross-sectional shape, but it is contemplated that the biasing rib 79 can have a different shape. The biasing rib 79 in FIG. 6 is longer than the support rib 77 so that the biasing rib 79 is able to bend the retention flange 39 on the spout 30 when the cap 63 is secured to the container 50.

Figure 7:
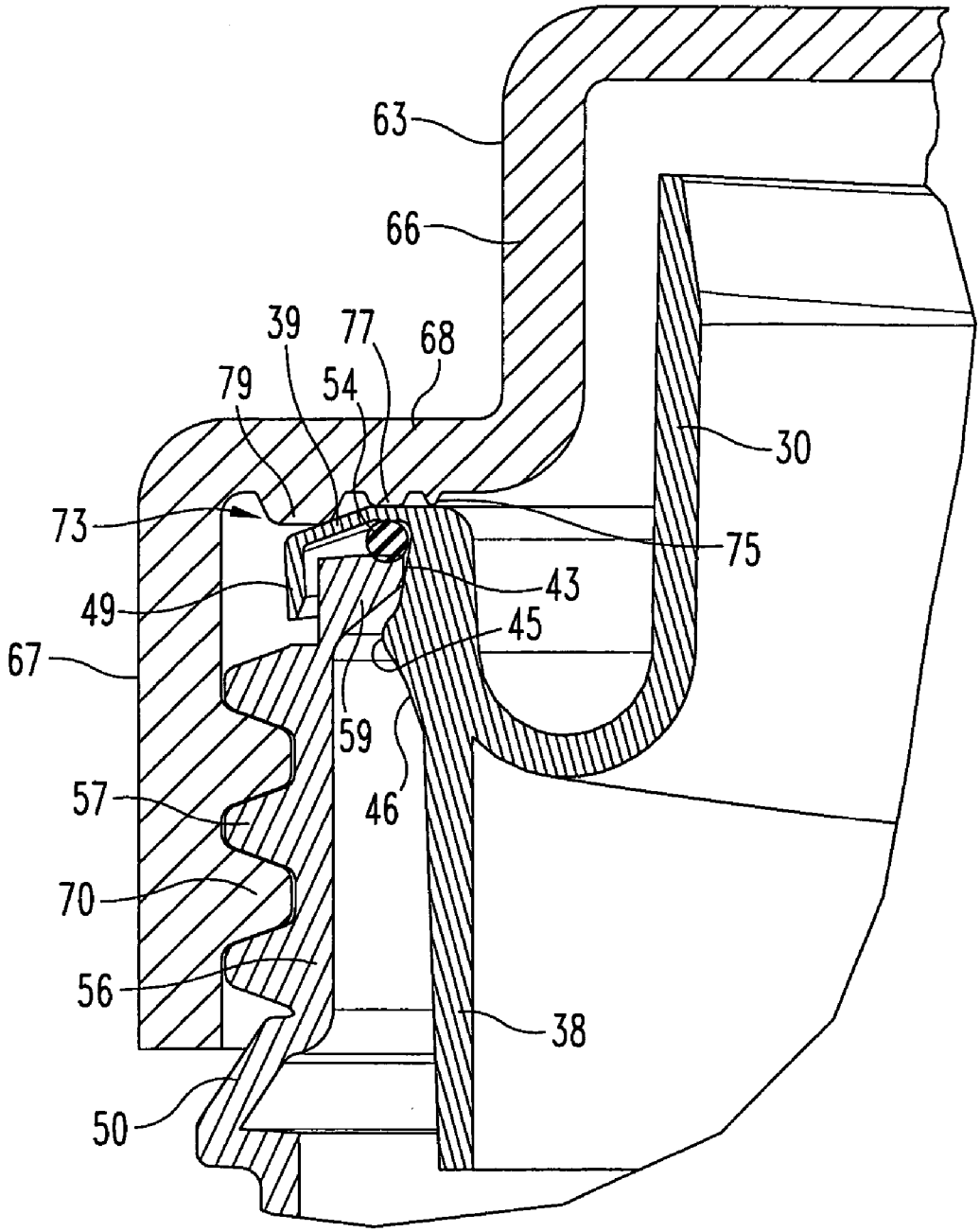
FIG. 7 is a cross-sectional view of the FIG. 5 sealing interface enclosed by the FIG. 6 cap.

FIG. 7 illustrates the sealing interface when the cap 63 is secured. As the cap 63 is tightened onto the container 50, the biasing rib 79 bends the retention flange 39 toward the rim member 59. The retention flange 39 is generally thinner than the rest of the spout 30 and made of deformable material, like plastic, so that the biasing rib 79 is able to bend the retention flange 39 at the lip 49. In doing so, the seal 54 is compressed and biased in a radially inwards manner towards the inside of the container 50. The seal rib 75 along with the other seal structures 73 form the seal between the cap 63 and the spout 30. Occasionally, during manufacturing, assembly and/or use, the rim member 59 can be bent or skewed so that the seal 54 is biased outwardly when the spout 30 is attached. Even when the rim member 59 is skewed, the bending of the retention flange 39 by the biasing rib 79 causes the seal 54 to remain inwardly biased. With both the biasing rib 79 on the cap 63 and the retention surface 43 on the spout 30, seal 54 remains seated at the interface between the retention surface 43 and the retention flange 39. The support rib 77 is positioned over the seal 54 so as to create a compressive force between the retention flange 39 and the rim member 54. In another form, it is envisioned that the support rib 77 can be eliminated such that the biasing rib 79 mainly applies the compressive force to the seal 54. With the cap 63 secured to the container 50 in such a manner, the risk of fluid leakage from the container 50 is reduced.

As should be appreciated, the unique structure of the spout 30 as well as the unique technique for assembling the spout 30 with the container 50 helps to ensure that the spout seal is properly located so that leakage from the container 50 is minimized. It should be recognized that the spout 30, the container 50 and/or the cap 63 can be shaped differently in other embodiments. As a non-limiting example, it is envisioned that the shape of the sidewall 38 at surface 47 can be straight or even in part outwardly flared. Even when shaped in such a manner, the seal 54 can still tend to be biased away from the correct seal location, and consequently, the above-discussed seal biasing mechanism, or some equivalent, still needs to be implemented. Additionally, it is contemplated that features from the present invention can be used in different types of containers than those discussed above.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A container assembly, comprising:

a container to contain a fluid;

a spout coupled to the container for pouring the fluid from the container, the spout including a retention flange to retain the spout on the container;

a seal disposed between the retention flange and the container;

a cap including a bias member that bends the retention flange to hold the seal in position to seal the container with the spout;

wherein the spout includes a retention surface that tapers towards the retention flange to bias the seal towards the retention flange; and wherein together the bias member on the cap and the retention surface on the spout hold the seal in the position to seal the container with the spout.

2. The container assembly of claim 1, further comprising:

means for biasing the seal towards the retention flange, wherein the means for biasing the seal includes the retention surface.

3. The container assembly of claim 1, wherein:

the retention flange extends radially outwards from the spout and has a radially outer edge portion; and the bias member contacts and bends the retention flange proximal the outer edge portion to apply force against the seal in a radially inward direction.

4. The container assembly of claim 1, wherein the cap is secured to the container.

5. The container assembly of claim 1, wherein the cap includes a seal member that contacts the spout to minimize leakage between the cap and the spout.

6. The container assembly of claim 1, wherein the cap includes a support member that compresses the seal between the retention flange of the spout and the container.

7. The container assembly of claim 1, further comprising:

means for containing the fluid, wherein the means for containing the fluid includes the container;

means for pouring the fluid from the means for containing the fluid, wherein the means for pouring the fluid includes the spout;

means for sealing the means for containing the fluid with the means for pouring the fluid, wherein the means for sealing includes the seal; and means for holding the seal in the position to seal the container with the spout, wherein the means for holding the seal includes the cap.

8. The container assembly of claim 1, wherein:

the cap includes a support rib positioned radially inward from the bias member to press the retention flange against the seal; and the bias member is longer than the support rib to bend the retention flange.

9. The container assembly of claim 8, wherein:

the cap includes a seal rib positioned radially inward from the support rib; and the seal rib is slightly longer than the support rib to seal against the retention flange.

10. A container assembly, comprising:

a container to contain a fluid;

a spout coupled to the container for pouring the fluid from the container, the spout including a retention flange to retain the spout on the container;

a seal disposed between the retention flange and the container;

a cap including a bias member that bends the retention flange to hold the seal in position to seal the container with the spout;

wherein the cap includes a support rib positioned radially inward from the bias member to press the retention flange against the seal; and wherein the bias member is longer than the support rib to bend the retention flange.

11. The container assembly of claim 10, wherein:

the cap includes a seal rib positioned radially inward from the support rib; and the seal rib is slightly longer than the support rib to seal against the retention flange.

12. The container assembly of claim 10, further comprising:

means for biasing the seal towards the retention flange, wherein the means for biasing the seal includes the retention surface.

13. The container assembly of claim 10, wherein:

the retention flange extends radially outwards from the spout and has a radially outer edge portion; and the bias member contacts and bends the retention flange proximal the outer edge portion to apply force against the seal in a radially inward direction.

14. The container assembly of claim 10, wherein the cap is secured to the container.

15. The container assembly of claim 10, wherein the cap includes a seal member that contacts the spout to minimize leakage between the cap and the spout.

16. The container assembly of claim 10, wherein the cap includes a support member that compresses the seal between the retention flange of the spout and the container.

17. The container assembly of claim 10, further comprising:

means for containing the fluid, wherein the means for containing the fluid includes the container;

means for pouring the fluid from the means for containing the fluid, wherein the means for pouring the fluid includes the spout;

means for sealing the means for containing the fluid with the means for pouring the fluid, wherein the means for sealing includes the seal; and means for holding the seal in the position to seal the container with the spout, wherein the means for holding the seal includes the cap.

* * * * *

UNITED STATES PATENT AND TRADEMARK OFFICE

CERTIFICATE OF CORRECTION

PATENT NO. : 7,353,973 B2
APPLICATION NO. : 11/080269
DATED : April 8, 2008
INVENTOR(S) : Robert D. Rohr It is certified that error appears in the above-identified patent and that said Letters Patent is hereby corrected as shown below:

Title Page, Item [56], References Cited, FOREIGN PATENT DOCUMENTS, please add --WO 2004/010038 A2 01/2004--

Signed and Sealed this

Twenty-fourth Day of June, 2008

JON W. DUDAS
*Director of the United States Patent and Trademark Office*